US007832465B2

(12) United States Patent
Zou et al.

(10) Patent No.: US 7,832,465 B2
(45) Date of Patent: Nov. 16, 2010

(54) AFFORDABLE AND EASY TO INSTALL MULTI-ZONE HVAC SYSTEM

(76) Inventors: Shazhou Zou, 14376 Dorsey Mill Rd., Glenwood, MD (US) 21738; Victor W Wang, 12487 Marstan Moor La., Herndon, VA (US) 20171; Jian Mao, 14376 Dorsey Mill Rd., Glenwood, MD (US) 21738; Tianxin Wang, 9768 Early Spring Way, Columbia, MD (US) 21046

( * ) Notice: Subject to any disclaimer, the term of this patent is extended or adjusted under 35 U.S.C. 154(b) by 1149 days.

(21) Appl. No.: 10/702,241

(22) Filed: Nov. 6, 2003

(65) Prior Publication Data

US 2004/0194484 A1 Oct. 7, 2004

Related U.S. Application Data

(60) Provisional application No. 60/424,673, filed on Nov. 7, 2002.

(51) Int. Cl.
*F24F 3/00* (2006.01)

(52) U.S. Cl. ..... 165/205; 165/209; 165/212; 236/49.3; 454/229; 700/11; 700/17; 700/19; 700/277; 700/278

(58) Field of Classification Search ..... 165/205, 165/207, 208, 209, 212, 218; 236/49.3; 454/229; 700/11, 17, 19, 276, 277, 278; 704/274, 275, 276; 702/130
See application file for complete search history.

(56) References Cited

U.S. PATENT DOCUMENTS 4,530,395 A 7/1985 Parker et al.
4,646,964 A 3/1987 Parker et al.
4,931,948 A 6/1990 Parker et al.
5,271,558 A 12/1993 Hampton
5,341,988 A * 8/1994 Rein et al. ..... 236/49.3
5,361,985 A * 11/1994 Rein et al. ..... 236/49.3
5,364,304 A * 11/1994 Hampton ..... 236/49.3
5,385,297 A * 1/1995 Rein et al. ..... 236/49.3
5,390,206 A * 2/1995 Rein et al. ..... 236/49.3
5,481,481 A * 1/1996 Frey et al. ..... 700/276
5,810,245 A * 9/1998 Heitman et al. ..... 236/49.3
5,833,134 A 11/1998 Ho et al.
6,029,092 A * 2/2000 Stein ..... 700/11
6,192,282 B1 * 2/2001 Smith et al. ..... 700/17
6,229,433 B1 * 5/2001 Rye et al. ..... 340/310.12
6,838,978 B2 * 1/2005 Aizu et al. ..... 340/286.02
6,967,565 B2 * 11/2005 Lingemann ..... 700/17
7,156,316 B2 * 1/2007 Kates ..... 165/208
7,163,156 B2 * 1/2007 Kates ..... 236/49.3
7,168,627 B2 * 1/2007 Kates ..... 236/49.3
7,383,148 B2 * 6/2008 Ahmed ..... 702/130

(Continued)

*Primary Examiner*—Ljiljana (Lil) V Ciric

(57) ABSTRACT

The present invention is directed to a multiple zone climate control system which includes a HVAC unit that supplies conditioned air to more than one zone, a zone controller in each zone, a central controller, one or more air flow rate regulating devices in each zone, and a digital wireless network connecting the air flow rate regulating devices, zone controllers and the central controller. The multiple zone climate control system is capable of energy efficiently regulating temperature in each zone independently as well as providing other air conditioning functions such as humidifying, cleaning and filtering air in each zone independently. The multiple zone climate control system can be installed in a single zone climate control system to convert it into a multiple zone climate control system.

9 Claims, 9 Drawing Sheets

U.S. PATENT DOCUMENTS

2001/0041982 A1* 11/2001 Kawasaki et al. ..... 704/275
2002/0171379 A1* 11/2002 Adamson ..... 315/312
2003/0011467 A1* 1/2003 Suomela ..... 340/7.1
2003/0050737 A1* 3/2003 Osann, Jr. ..... 700/276
2004/0175078 A1* 9/2004 Imamura ..... 385/88
2004/0260407 A1* 12/2004 Wimsatt ..... 700/19

* cited by examiner

AFFORDABLE AND EASY TO INSTALL MULTI-ZONE HVAC SYSTEM

The present application claims priority under 35 U.S.C. §119(e) to U.S. Provisional Application No. 60/424,673, filed on Nov. 7, 2002, which provisional application is hereby incorporated by reference in its entirety.

BACKGROUND OF THE INVENTION

1. Field of the Invention

This invention relates to a duct type air conditioning system (AC system), which is capable of energy efficiently regulating temperature in each room (or zone) independently as well as providing other air conditioning functions such as humidifying, cleaning and filtering air in each room independently.

2. Background Information

In most residential houses, one or more central HVACs (heating, ventilation and air-conditioning) are used to send conditioned air to designated rooms. Usually, one thermostat controls the temperature of several rooms or zones. Due to differences in ventilation efficiency and exterior thermal load among different zones, not all zones can achieve the temperature set at the single thermostat control. It is common that rooms on the upper floor have much higher temperature in the summer than rooms in lower floor. In winter, rooms in northwest corner or above the garage of a house usually have lower temperatures than other rooms. With a single thermostat, occupants in different zones cannot select their own comfort level.

Moreover, for a zone where the thermostat is not located to reach a certain level, all other zones have to rise or fall at the same time. This is a great waste of energy. Therefore, it is highly desirable that the temperature and possibly other air comfort and quality measures in each zone can be controlled individually.

These solutions, however, are usually complex and expensive and thus hard to justify from cost saving point of view. For example, the solutions by Parker et al. (U.S. Pat. Nos. 4,530,395, 4,646,964, 4,931,948) require dampers fitted inside ducts, thus incurring high installation and maintenance costs. Ho et al. (U.S. Pat. No. 5,833,134) use dampers in registers to control airflows, but the design calls for the register dampers to be manually controlled, thus barring the possibility of automatic zone temperature control. Hampton et al. (U.S. Pat. No. 5,271,558) require turbines be placed in the register and the turbines be connected to power generators. Their invention does not have coordination among zone thermostats either. The current invention presents a simple and inexpensive individual-zone controlled HVAC system.

SUMMARY OF THE INVENTION

This invention provides a system capable of regulating temperature (and/or humidity, air quality, etc.) in each zone independently, which can be incorporated into a new AC system as well as be added on to an existing AC system with low cost and easy installation. The system comprises a HVAC unit that supplies conditioned air; a central controller that controls the HVAC unit and coordinates with the control unit in each zone; a zone controller in every zone to control the zone air flow rate regulating devices, which could be dampers, air blowers (boosters) or the combination of dampers and boosters, and send zone data to central controller; air flow rate regulating devices such as battery powered dampers on registers (with and without an air blower that may require additional power) and/or air blowers in every zone to regulate the flow rate of conditioned air; and use of intelligent digital wireless communication network to connect all components of the system listed above. This system avoids the need of extensive wiring and large-scale modification on the existing ductwork of a building to realize independent zone climate control.

Central control unit has multiple functions. It coordinates the zone control units, controls the HVAC unit and may also function as a zone controller that controls the airflow rate regulating devices in the zone where the central controller is located. After the zones have reached the preset conditions, the central controller shuts down the HVAC unit.

The central control unit controls whether the system is in a heating, cooling or ventilation state. The room (zone) controller detects the state in the corresponding room and act accordingly. For example, consider a situation where a room control unit sets the room temperature to be 70° F. and the actual room temperature is 65° F. If the central control unit sets the state as cooling, the room control unit will close the dampers and/or stop the boosters, so the cooling air from the duct will not enter the room. On the other hand, if the central control unit is in the heating state, the room control unit will open the dampers and/or start the boosters. When the central controller sets the system state to be ventilation, all dampers will usually be kept in an open status.

The control units contain microprocessors and can be programmed to deliver sophisticated and concerted functions. For example, the degree of openness of a damper and the speed of the fans in the boosters can be programmed as a function of the speed of temperature change and the difference between the set and actual temperatures in the zone, in order for zones to reach the set temperature simultaneously. Battery is preferably used to supply power to the central and zone control units.

The status of a damper and/or booster is controlled by the central and zone control units to regulate flow rate of conditioned air into each zone. In the simplest case, the damper can just assume two statuses, open and closed, the booster can also have only two states: on and off, if a booster is incorporated into the system. In a more sophisticated case, a damper can assume any status between being complete open and complete closed, and an algorithm can be programmed to make the degree of openness of a damper to be a function of temperature difference between the actual and set temperature of the zone; the status/performance of the boosters can also be adjusted accordingly. In the most sophisticated case, the central control unit and zone control units work together to control the status of dampers and the status/performance of the boosters in all zones in order to achieve the set conditions in every zone in the most efficient manner. As the control units are programmable, the control algorithm can be set at installation and changed when needed later.

As there are usually multiple zones in a building, it is important there is no communication interference between control unit in one zone and airflow rate regulating devices in another. There are many well know methods to address this issue. Various means are available to pair zone control units and their corresponding air flow rate regulating devices (powered wireless registers). For example, every component can be assigned a unique network address in the wireless network composed of the HVAC unit, the central controller, zone controller and air flow rate regulating devices. A standard network communication protocol can be used to carry messages between the network components without possibility of interference/miscommunication. For example, one means is to pair a zone controller and its zone air flow rate regulating device by registering the air flow rate regulating device to the zone controller through a initial "talk" at time of installation.

The powered dampers in this invention are built into a register, which is the piece that covers the exit of a duct into a zone. Registers can easily be removed and exchanged without having to tear open the ducts. This feature in combination with the wireless communication feature makes the invention easy to install and maintain. A communication unit on the damper receives instructions from its zone controller and sends commands to a mechanism that controls the status of the damper utilizing motor or other suitable electro-magnetic device.

The boosters in this invention can also be built into a register, which is the piece that covers the exit of a duct into a zone. Fans are added to the registers. The boosters utilize the fan to boost the airflow rate. This feature in combination with the wireless communication feature makes the invention easy to install and maintain. The registers equipped with boosters can also have dampers on their covers. A communication unit on the booster receives instruction from its zone controller and sends commands to a mechanism that controls the status of the booster. In this case, battery power may not be sufficient. An external AC or DC power source can be used.

Battery can be used to supply power to all electrical components on a damper. Low power consumption circuits and components make it possible for the batteries to last a long time. However, battery level detection function can be built in. The damper battery level can be checked regularly. Varieties of well known methods can be used to check the battery level. If battery level is deemed lower, a signal or sign can be displayed on the zone controller or on the damper.

There can be a manual override for the airflow regulating device status on the zone controller. When the manual override is engaged, the zone controller set the airflow-regulating device in a certain status until the override mode is revoked.

Closing registers will usually reduce total airflow volume. Too little airflow may have adverse effect on the HVAC unit, such as icing or overheating. A temperature sensor can be placed inside or on the duct wall nearest to the heat exchange component of the central HVAC unit. The sensor sends measured temperature to the central control unit. If freezing or over heating situation is detected, the central control unit could change the heating or cooling operation into ventilation operation.

Too low airflow volume may also result in unacceptable airflow pressure in the HVAC unit and the ducts. To ensure the airflow volume is acceptable, a number of means can be employed, including keeping certain registers always open, using booster fans, allowing a certain amount of airflow even when a register is closed, setting zone dead band according to degree of temperature fluctuation in the zone, using a pressure sensor in the HVAC unit or the ducts to prevent too low airflow volume etc. One example is to set a minimal number of the dampers that need to be always open. Another example is allowing the damper to cover only partial duct even in fully closed position. A third example is to allow three status of the damper: fully open, partially open and fully closed (damper fully covers the exit of the duct in its fully close status); algorithms can be applied to dynamically control these dampers to keep certain flow rate while having maximal independent climate control and energy saving effects.

For many homes, it is safe to use dampers described above as the only airflow rate regulating device in the system. However, some homes have ducts poorly constructed, which have too low flow rate even in normal operating condition (single zone). Using dampers only in these homes to achieve multi-zoning may result in unacceptable low flow rate and therefore may cause problems to the central HVAC unit. For these homes, the boosters described above or the combination of boosters and dampers above is the preferred airflow rate regulating devices.

BRIEF DESCRIPTIONS OF DRAWS

The invention described in above summary is further explained with the following drawings that illustrate specific embodiments of the invention.

DETAILED DESCRIPTION OF DRAWS AND PREFERRED EMBODIMENT

The following detailed description is provided as an aid to those desiring to practice the invention disclosed herein, it is not, however, to be construed as limiting to the instant invention as claimed, since those of ordinary skill in the art will readily understand that variations can be made in the examples, procedures, methods and devices disclosed herein, without departing from the spirit or scope of the instant invention. As such the present invention is only limited by the scope of the claims appended hereto and the equivalents encompassed thereby.

Figure 1:
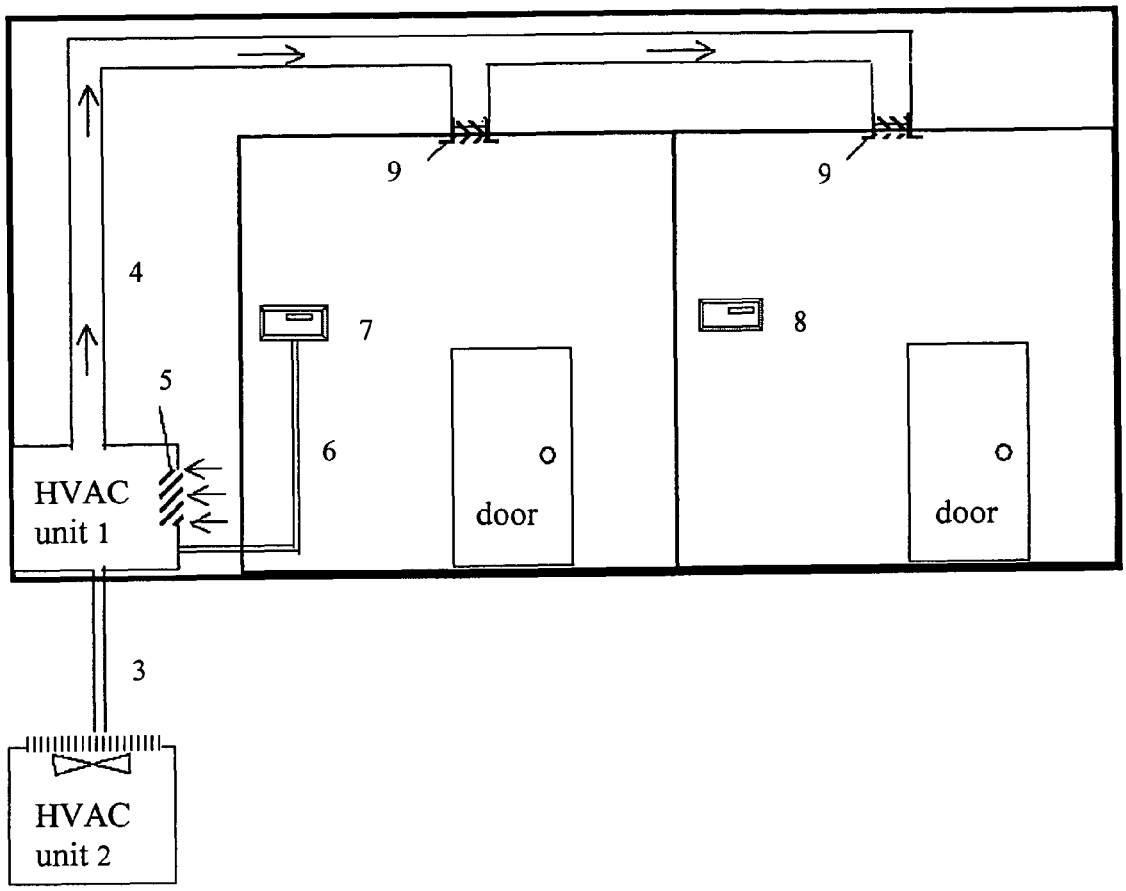
FIG. 1 shows schematically the overall concept of the invention embodied herein.

FIG. 1 is a preferred embodiment of multi-zone HVAC system. A HVAC unit 1 supplies conditioned air to two rooms through duct 4. Outdoor HVAC unit 2 connects with the indoor HVAC unit 1 though duct 3. Air circulates in the room through duct 4 and HVAC air intake 5. A central controller 7 serves both as a zone controller and as a central controller. As a zone controller, it controls register (air flow rate regulating device) 9 and communicates conditions of the room to central controller 7. As a central controller, it coordinates with the zone controllers 8 and controls the HVAC unit through wire 6. The conditioned air exits into the rooms through registers 9, which is shown in greater detail in FIG. 2.

Figure 2:
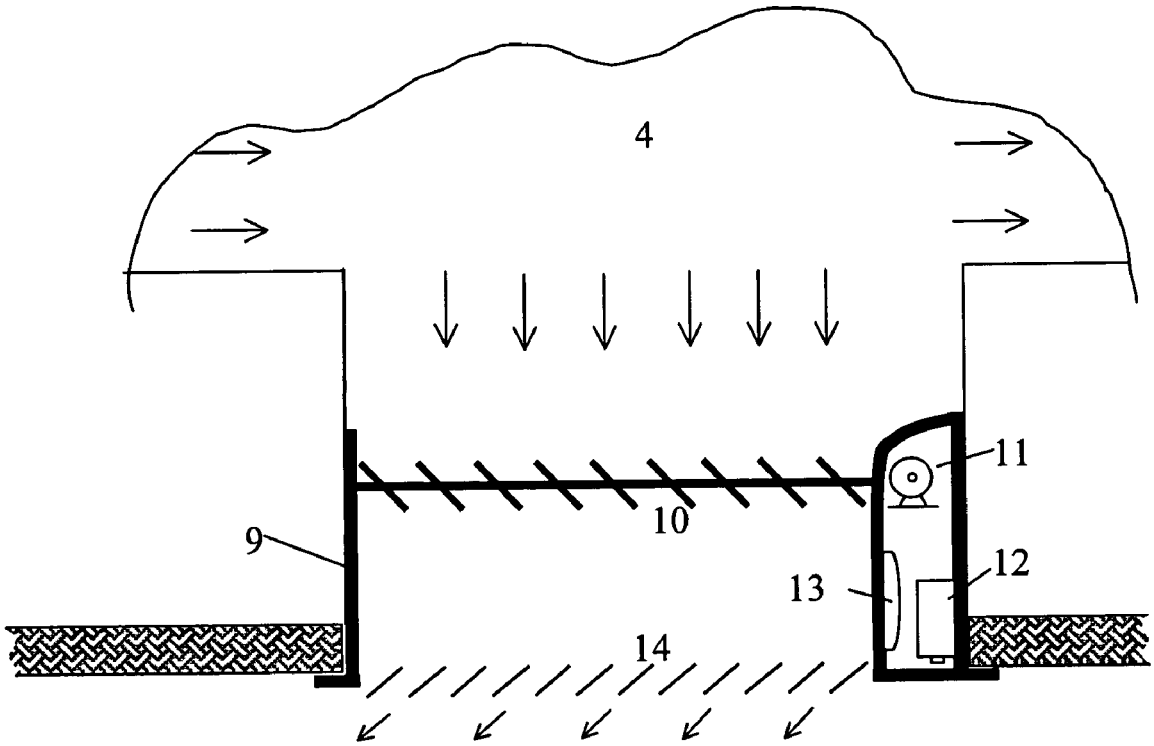
FIG. 2 shows a preferred embodiment of a wireless adjustable register using battery-powered damper.

In FIG. 2, register 9 consists of a built-in damper 10, a motor 11, one or more batteries 12, a wireless radio receiver and transmitter 13 and a screen 14; it could also contain build in fan or fans as a booster or contain both damper and booster. The battery powers the motor to open or close the damper.

Figure 3:
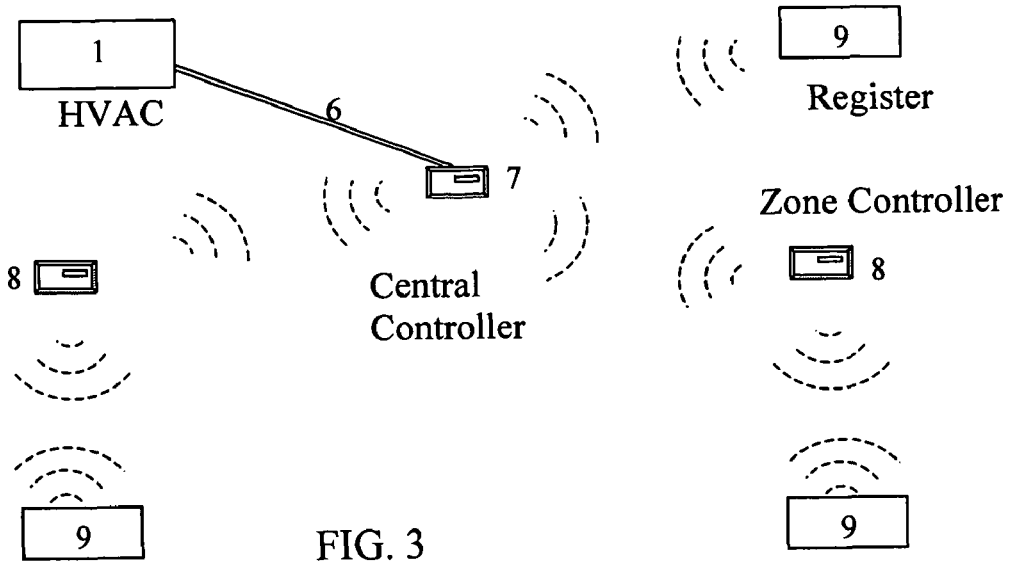
FIG. 3 shows a preferred embodiment of the intelligent digital wireless communication network.

FIG. 3 shows the digital wireless network that connects the central controller 7, the zone controller 8, and the registers 9. Central controller 7 communicates with the HVAC unit through wire 6. Each component in the wireless network has a unique network ID and a zone controller is programmed to communicate only with register(s) 9 inside this zone and the central controller 7.

Figure 4:
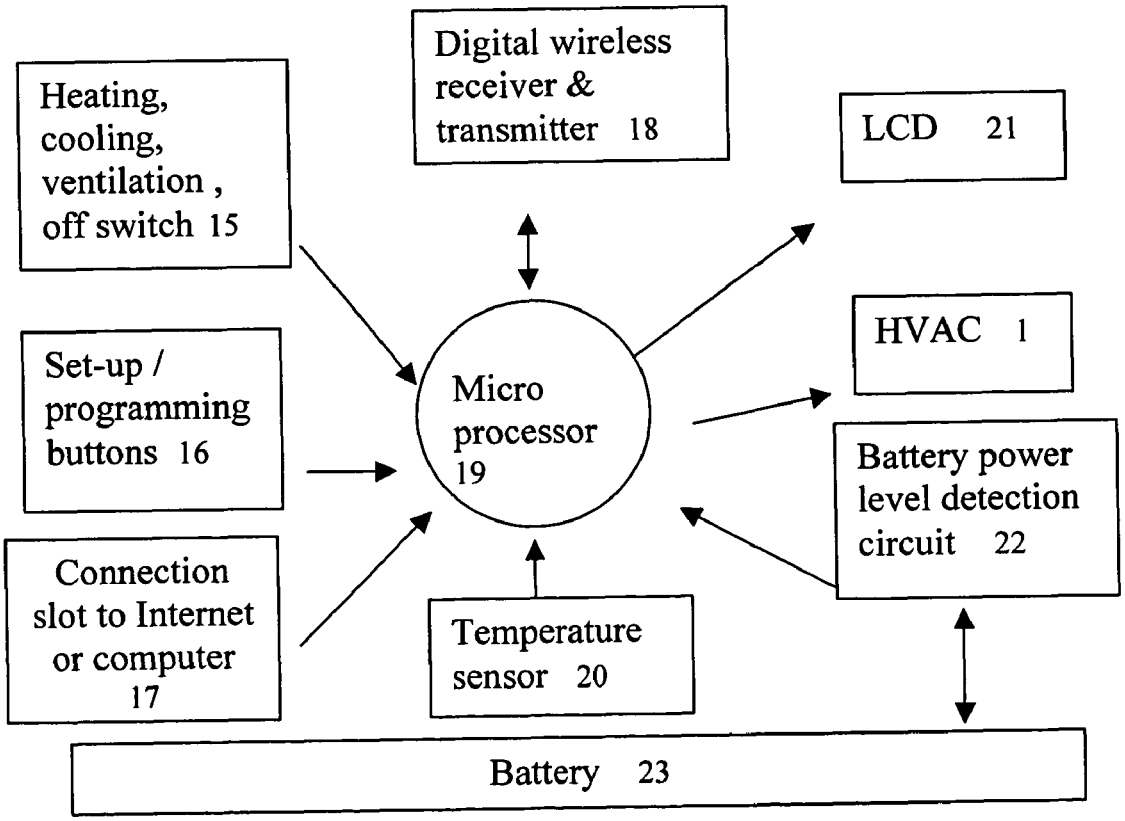
FIG. 4 is a block diagram for a preferred embodiment for the central control unit.

FIG. 4 is a block diagram of a preferred embodiment of the central controller that also functions as a zone controller. Switch 15 sets the state of the HVAC to be either heating, or cooling or ventilating or off. Buttons 16 on the controller are used to program desired zone temperatures and can be used to enter simple instructions to Microprocessor 19, which can have built-in control logic as well. Slot 17 is a connection to Internet or a personal computer. For example, it can be a USB slot or a wireless communication port. The digital wireless receiver and transmitter 18 communicate with zone registers and other zone controllers. A temperature sensor 20 senses and reports the ambient temperature to the microprocessor 19. Battery 23 supplies power to all components of the central controller. LCD 21 displays information including: a) the set temperature, b) the ambient temperature, c) sign for low battery power for zone controller, d) sign for low battery power for the register(s), and e) if manual override is engaged in the register(s). To reduce power consumption on the register battery, microprocessor 19 is responsible to check on the power level of the register battery, instead of the register reporting its own power level. When desired conditions in all zones are achieved, HVAC is turned off.

Figure 5:
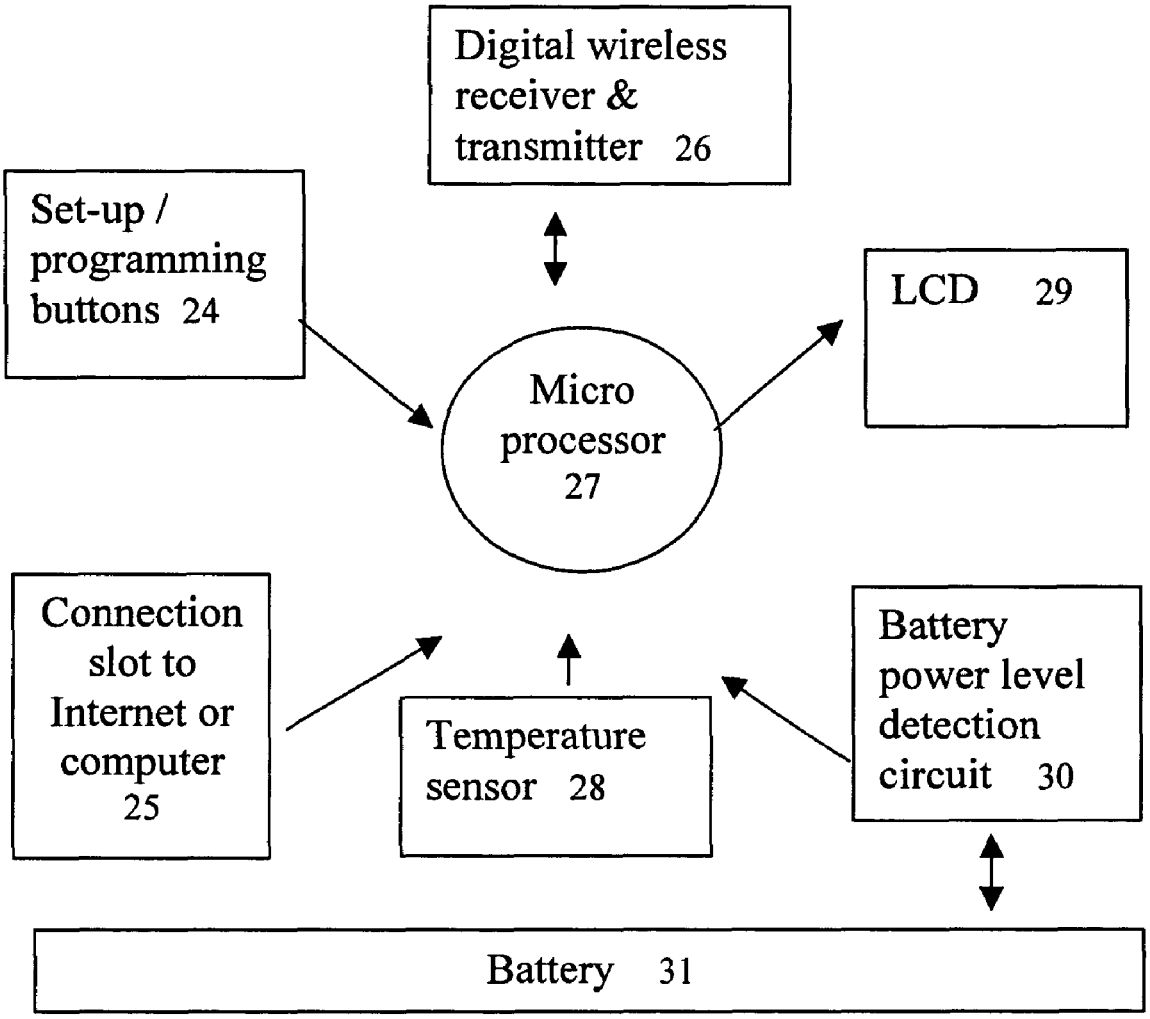
FIG. 5 is a block diagram for a preferred embodiment for the zone control unit.

A preferred embodiment of the zone controller is shown in FIG. 5. Compared to the central controller depicted in FIG. 4, the zone controller does not directly control the HVAC and does not set the HVAC state (heating, cooling, ventilation).

Figure 6:
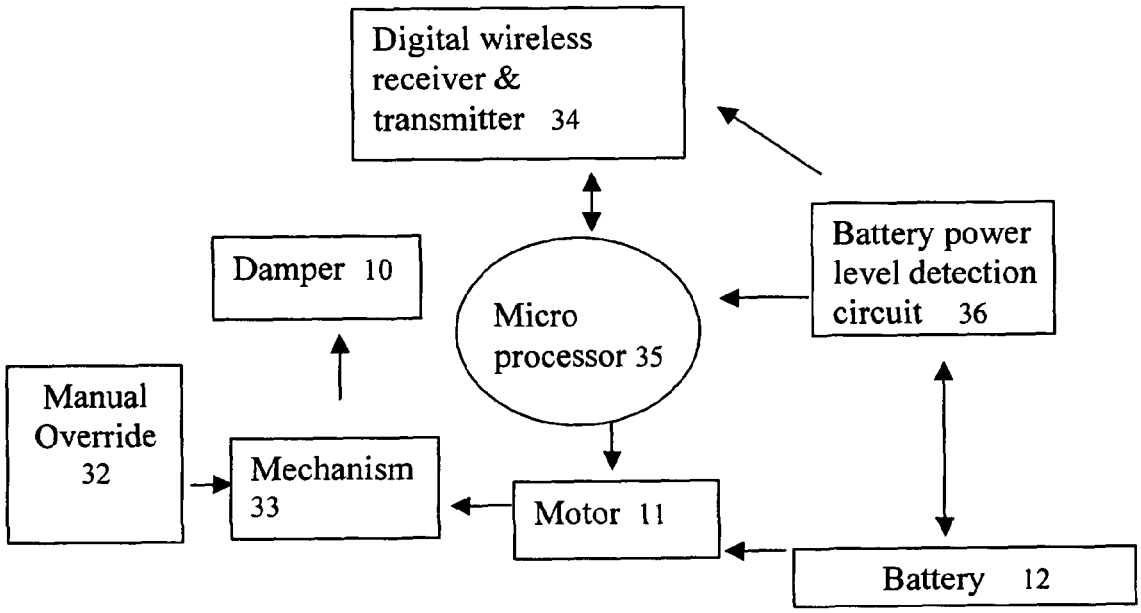
FIG. 6 is a block diagram that shows an example of the components on a register and their relationship.

Components on a powered wireless adjustable damper embodied here are shown in FIG. 6. Circuit 35 processes the instructions received from zone controller through wireless transmitter 34 and instructs motor 11 to drive mechanism 33 to adjust damper status accordingly to status between completely open and completely close. A manual override is built-in to override instructions from zone controller. When manual override is engaged, instruction from zone controller is ignored. Information sent to the zone controller wirelessly includes the damper status, battery level and if manual override is engaged.

Table 1 tabulates an example for the logic a zone controller employs to control the register status. The symbol Δ represents the dead band, which is the preset tolerance range on temperature before damper status is changed. The tolerance range for different zones can be set to different values. For example, if there is a zone that is more demanding than other zones in the sense that it is usually the last to reach the set temperature and the first to activate the HVAC unit, the tolerance range Δ for this zone could be set the largest to avoid frequent turning on and off of the HVAC unit.

TABLE 1

Damper status control logic for two-position damper

| HVAC state\ Temp. Setting | Set > actual + Δ | Set < actual − Δ | Otherwise |
|---|---|---|---|
| Heating | Open | Close | No Action |
| Cooling | Close | Open | No Action |
| Ventilation | Open | Open | Open |

Figure 7:
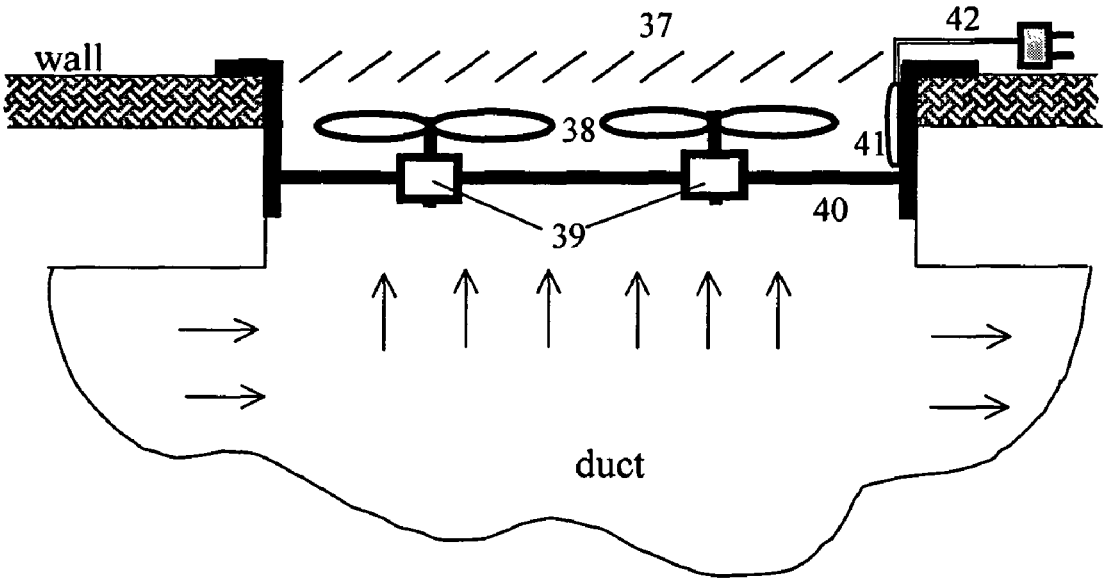
FIG. 7 shows another preferred embodiment of the register with an airflow booster.

FIG. 7 is the side section view of a booster embodied here.

The booster can be a powered adjustable register depicted in FIG. 2 with one or more fans 38 added.

The powered damper part may not necessarily be included. A wireless signal transceiver 41 communicates with the zone controller and sends control signal to motor 39, which controls fan 38 through certain mechanism. Fan 39 is mounted on the walls of the booster through thin metal rods 40. Screen 37 protects the fan and diffuse airflow. Power is brought to the booster through electrical wire 42. Since the booster fans themselves serve as dampers when not operating, a blade damper may or may not be needed.

A HVAC unit operates most efficiently in certain airflow/air pressure range. Too little airflow may cause overheating or icing. There are many means to prevent this from happening, some of which are listed below:

1. always keep certain percentage, say 20-30%, of registers open. Usually, there are enough registers in closets and bathrooms to meet this needs;
2. use booster registers in selected locations to boost airflow. In general, the boosters should be used in zones where the temperature conditions are more difficult to satisfy;
3. register dampers can be designed such that a certain percentage of airflow is allowed even in a close position.
4. the HVAC is not allowed to remain open for prolonged period if less than a certain percentage of register is open. This may result in the set temperature in certain zone not being satisfied in one heating or cooling cycle. If the set temperature cannot be satisfied in multiple cycles, a register booster is recommended.
5. temperature sensors can be installed near the air-handler to detect icing or overheating. The system will be shut down if the temperature rise above or drop below a set level. Pressure sensor can also be installed, if the air pressure in the HVAC system is too high, the control unit will open more dumpers or start more boosters or shut off the HVAC system to release the pressure.
6. width of the dead band for a zone can be set manually or automatic according to the speed of the temperature fluctuation in that zone. In general, the faster the temperature fluctuates, the wider the dead band.

In practice, a combination of the above measures can be used. For example, a simple means would be to keep 20% of registers always open and use boosters in 20% of the remaining registers.

Figure 8:
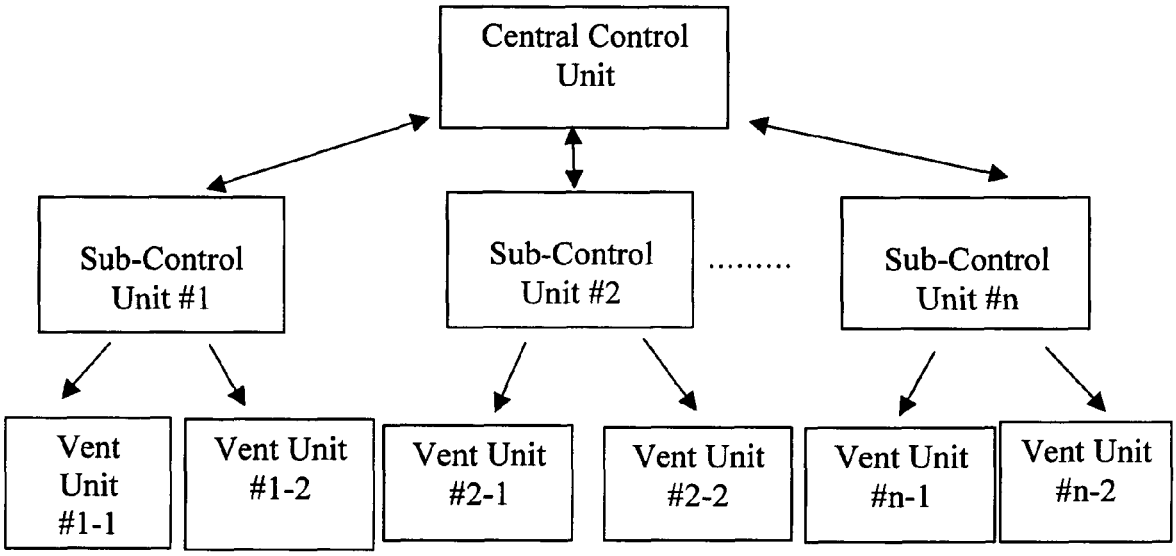
FIG. 8 depicts a preferred embodiment of the 3-layer structure of the intelligent digital wireless communication network.

Wireless communication system is needed to transmit information between the central (main) control unit, sub (zone) control units and vent units (registers). A digital wireless communication system is designed to have very low manufacturing cost, reliable communication at relatively low data rate. A design example is illustrated as the following:

FIG. 8 shows the 3-layer structure used with central unit on the top, the sub units in the middle and the vent units on the bottom.

Figure 9:
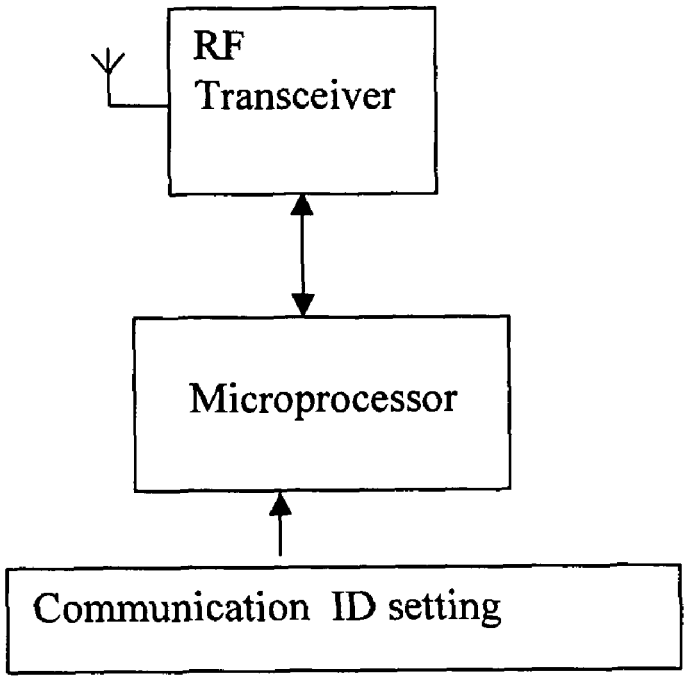
FIG. 9 is a preferred embodiment of the structure of a control unit (central or zone control unit) of the wireless communication system.

FIG. 9 shows the structure of a control unit including main (central) or sub (zone) control unit. A transceiver is sending or receiving RF (radio frequency) signal. The microprocessor is to act as encoder or decoder during signal transmitting or receiving mode. An unique ID/address is assigned to each central control unit during manufacturing, and the IDs of zone control units will be set during installation to corresponding the ID of the central control unit.

Figure 10:
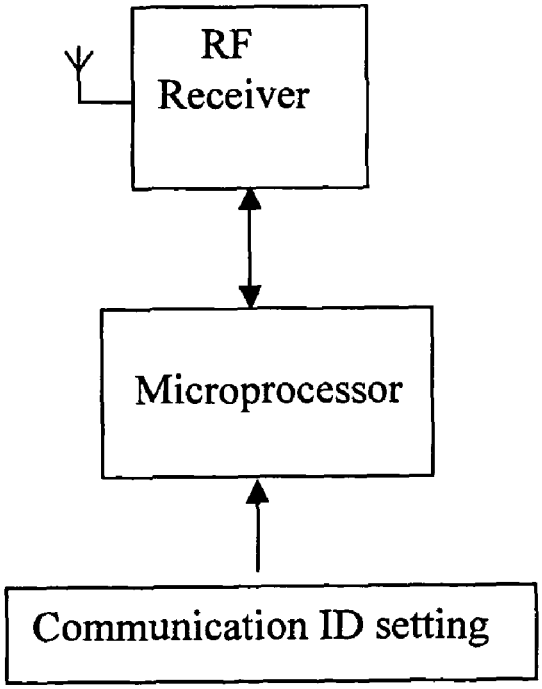
FIG. 10 is a preferred embodiment of the circuit structure of a vent unit.

FIG. 10 shows the structure of a vent unit. In the simplest case, it only contains a receiver in the RF part. If sending data to the sub control unit is desired, a transceiver will be used instead of the receiver.

Figure 11:
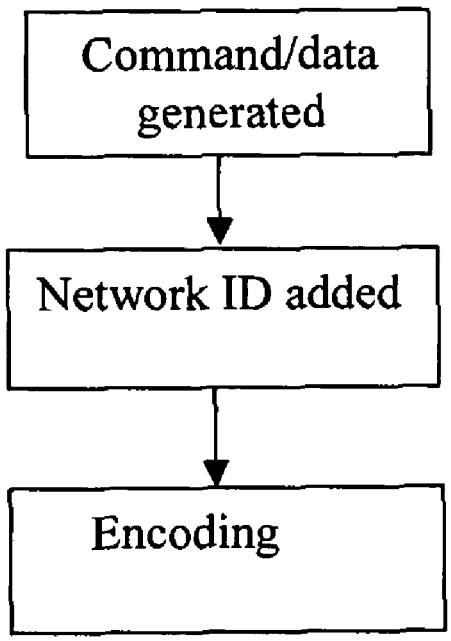
FIG. 11 is a preferred embodiment of the command/data transmitting process flow chart.

FIG. 11 is the command/data transmitting process flow chart. During transmitting mode, the microprocessor encodes signal with the command/data and the network ID of the unit it intends to send signal to and enable the RF transmitter to transmit radio signal.

Figure 12:
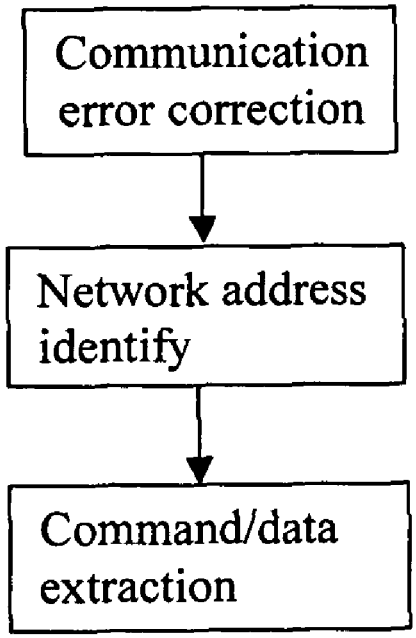
FIG. 12 is a preferred embodiment of command/data receiving process flow chart.

FIG. 12 is the command/data receiving process flow chart. During receiving mode, the microprocessor decodes signal received by the receiver, processes to accept or reject according the network ID and extracts command/data.

What is claimed is:

1. A multiple zone climate control system, comprising a. a HVAC unit that supplies conditioned air to more than one zone;

b. a zone controller in each zone;

c. a central controller, said central controller controls said HVAC unit to be in a state which is selected from heating, cooling, ventilating, and off; wherein the central controller shuts down the HVAC unit after all zones reach their preset conditions respectively;

d. one or more air flow rate regulating devices in each zone, wherein each said air flow rate regulating devices is powered and is built into a register, each said air flow rate regulating device comprises one or more dampers or boosters or combination thereof and an air flow rate regulating device controller, wherein said air flow rate regulating device controller can communicate with said zone controller and adjust the degree of openness of said damper accordingly or adjust the performance of said booster accordingly to reach a desired climate control which is set at the zone controller in each zone; and e. a digital wireless network that connects said central controller, said zone controllers and said air flow rate regulating devices, wherein said zone controllers communicate with the central controller and the air flow rate regulating devices through said digital wireless network.

2. The multiple zone climate system in claim 1, wherein said central controller and/or zone controller control the zone air flow rate regulating devices in a concerted fashion to reach optimal system performance according to an algorithm which are preset or later installed.

3. The multiple zone climate control system in claim 1, wherein said central controller has a zone controller component and functions as a zone controller as well.

4. The multiple zone climate control system in claim 1, wherein said one or more dampers are powered by one or more batteries if the air flow rate regulating device comprises one or more dampers.

5. The multiple zone climate control system in claim 4, wherein said zone controller can obtain information regarding a power level of the batteries and display an alert message when the power level is below a predefined level.

6. The multiple zone climate control system in claim 1, wherein said zone controller is embedded with a manual override mode, wherein when said manual override mode is activated, said zone controllers stop sending instructions to their zone air flow rate regulating devices so the zone air flow rate regulating devices' status remain unchanged until the manual override is revoked.

7. The multiple zone climate control system in claim 1, wherein temperature is used as the climate control criterion in said zone.

8. The multiple zone climate control system in claim 1, which uses a control algorithm/method comprising one or more of the following elements:

a. keeping certain percentage of said dampers open at all time, if the air flow rate regulating device comprises one or more dampers b. using said boosters in certain zones to boost airflow rate, if the air flow rate regulating device comprises one or more boosters, c. allowing certain amount of airflow into a zone even after the desired climate control are met, d. not allowing the HVAC unit work for longer than a predefined period of time when the percentage of the opened dampers is lower than a predefined value, and e. setting a zone's dead band width according to the speed of the zone's temperature fluctuation.

9. A method of converting a single zone HVAC system to a multiple zone HVAC system, comprising the following steps not necessarily in the following order:

a. installing a zone controller in each zone;

b. replacing some or all registers in a zone with air flow rate regulating devices, wherein each of said air flow rate regulating devices is powered and is built into a register, and each of said air flow rate regulating devices comprises one or more dampers or boosters or combination thereof, an air flow rate regulating device controller that can communicate with said zone controller and adjust the degree of openness of said damper accordingly or adjust the performance of said booster accordingly;

c. replacing the thermostat that is connected to said single zone HVAC unit with a central controller, said central controller controls said HVAC unit to be in a state selected from heating, cooling, ventilating, and off; and d. connecting said central controller, said zone controllers and said air flow rate regulating devices with a digital wireless network, wherein said zone controllers communicate with the central controller and said air flow rate regulating devices through said digital wireless network.

* * * * *